US005813899A

United States Patent [19]

Hartley

[11] Patent Number: 5,813,899

[45] Date of Patent: Sep. 29, 1998

[54] GAME CALL AND METHOD

[76] Inventor: Michael W. Hartley, 5335 W. Killarney Ct., Jasper, Ind. 47546

[21] Appl. No.: 786,857

[22] Filed: Jan. 22, 1997

[51] Int. Cl.[6] ..... G10D 13/06

[52] U.S. Cl. ..... 446/422

[58] Field of Search ..... 446/418, 419, 446/421, 422; 84/402, 403, 404

[56] References Cited

U.S. PATENT DOCUMENTS

| | | | |
|---|---|---|---|
| 273,414 | 3/1883 | Westphal | 446/421 |
| 427,274 | 5/1890 | Sherman . | |
| 471,046 | 3/1892 | Wilskey . | |
| 479,636 | 7/1892 | Droop . | |
| 1,490,914 | 4/1924 | Cornell | 446/422 |
| 2,137,651 | 11/1938 | Larrabee . | |
| 4,127,053 | 11/1978 | Cohen | 446/422 X |
| 4,422,262 | 12/1983 | Moss . | |
| 4,954,115 | 9/1990 | Metiva . | |
| 4,976,651 | 12/1990 | Frank . | |
| 5,066,260 | 11/1991 | Lindler . | |
| 5,158,494 | 10/1992 | Ball . | |
| 5,407,216 | 4/1995 | Liu | 446/422 X |
| 5,484,320 | 1/1996 | Becker . | |

*Primary Examiner*—Robert A. Hafer
*Assistant Examiner*—Jeffrey D. Carlson
*Attorney, Agent, or Firm*—Woodard,Emhardt,Naughton Moriarty & McNett

[57] ABSTRACT

A game call method and device for locating a wild turkey. A wooden knocker ball is caused to repeatedly strike the opposite sides of an elongated wooden open sided box. The wooden knocker ball is mounted on the box by a coil spring. The knocker ball is caused to strike the opposite sides in short fast bursts to make long distance travelling pecking sounds like the sounds of a woodpecker.

4 Claims, 3 Drawing Sheets

GAME CALL AND METHOD

FIELD OF THE INVENTION

The present invention relates to a game call and to a method for locating a wild turkey.

BACKGROUND OF THE INVENTION

There is disclosed in the prior art game calls for simulating the sound of a wild turkey. The U.S. Pat. No. 5,066,260 to Lindler discloses such a device. There are commercially available game calls which make sounds similar to the sounds that wild turkeys make. These sounds are known as purrs, cuts and yelps. When the wild turkey hears these sounds, it responds by making similar sounds or by making gobble sounds which aid the hunter in locating the turkey. Wild turkeys also respond to more distant natural loud sounds. The U.S. Pat. No. 4,954,115 to Metiva discloses a device which simulates the cry of an owl for attracting a turkey at long range.

It is an object of the present invention to provide an improved game call for a turkey.

A further object of this invention is to provide an improved method for locating a turkey.

SUMMARY OF THE INVENTION

One embodiment of the game call of the invention might include two opposite sides, or in other words, sound producing surfaces fixed in spaced relation to one another. There is also provided a handle fixed in relation to the opposite sides. A spring is secured to the handle and resiliently mounts a knocker which is positioned between the two opposite sides.

An embodiment of the method of the present invention might include locating a wild turkey by the steps comprising providing a game call which includes two opposites sides fixed in spaced relation to one another, a handle fixed in relation to the opposite sides, a knocker and a spring secured to the handle and resiliently mounting the knocker between the two opposite sides. The game call is grasped by the handle and the handle is moved back and forth so that the knocker is caused to strike against the opposite sides repeatedly. The moving is accomplished in short fast bursts so that the sound produced sounds like the pecking of a woodpecker. The turkey is located by listening for its gobble sound.

DESCRIPTION OF THE PREFERRED EMBODIMENT

Figure 1:
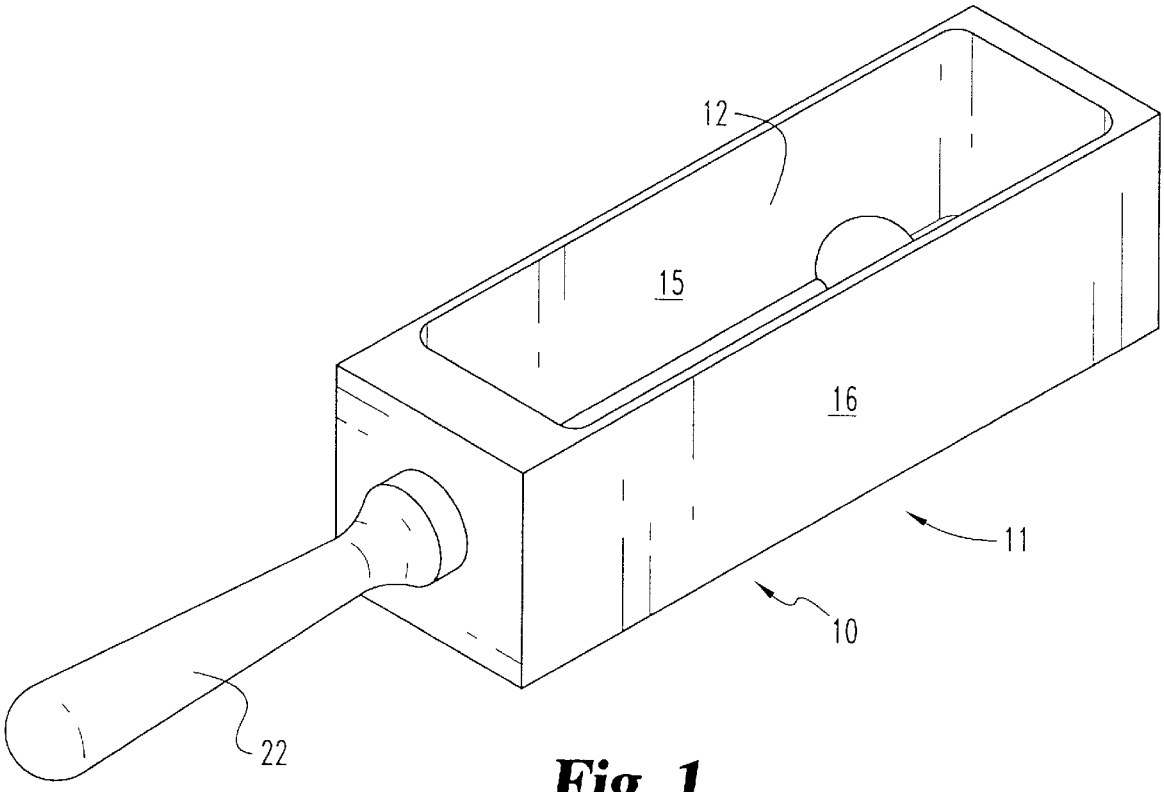
FIG. 1 is a perspective view of the game call of the present invention.
Figure 2:
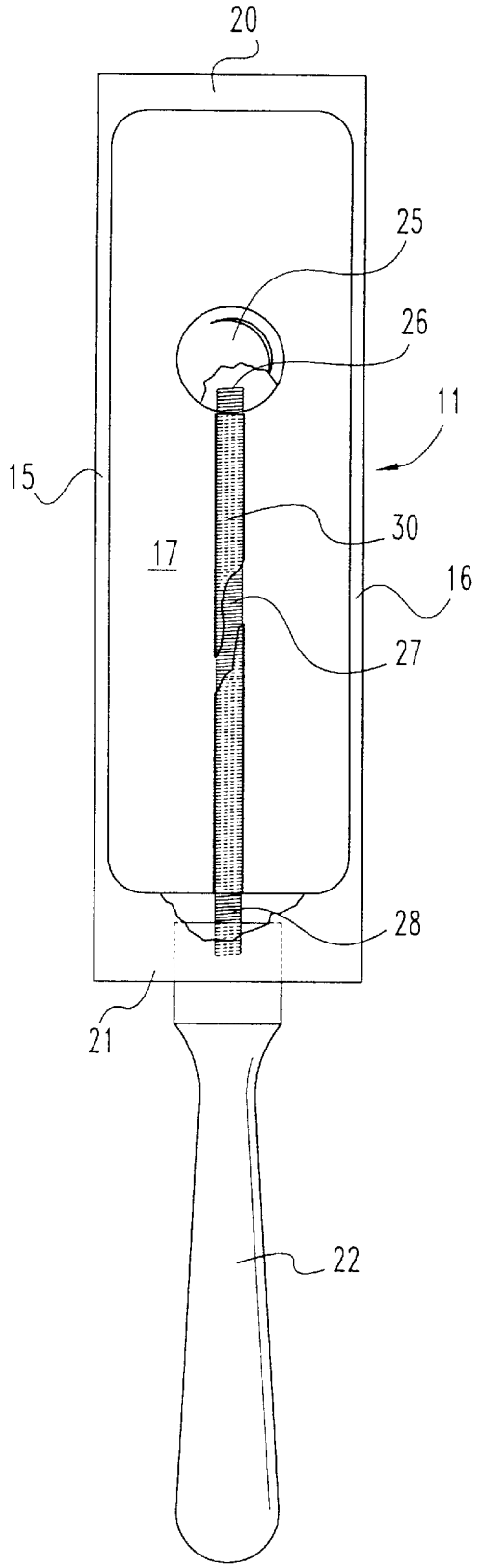
FIG. 2 is a front elevation.
Figure 3:
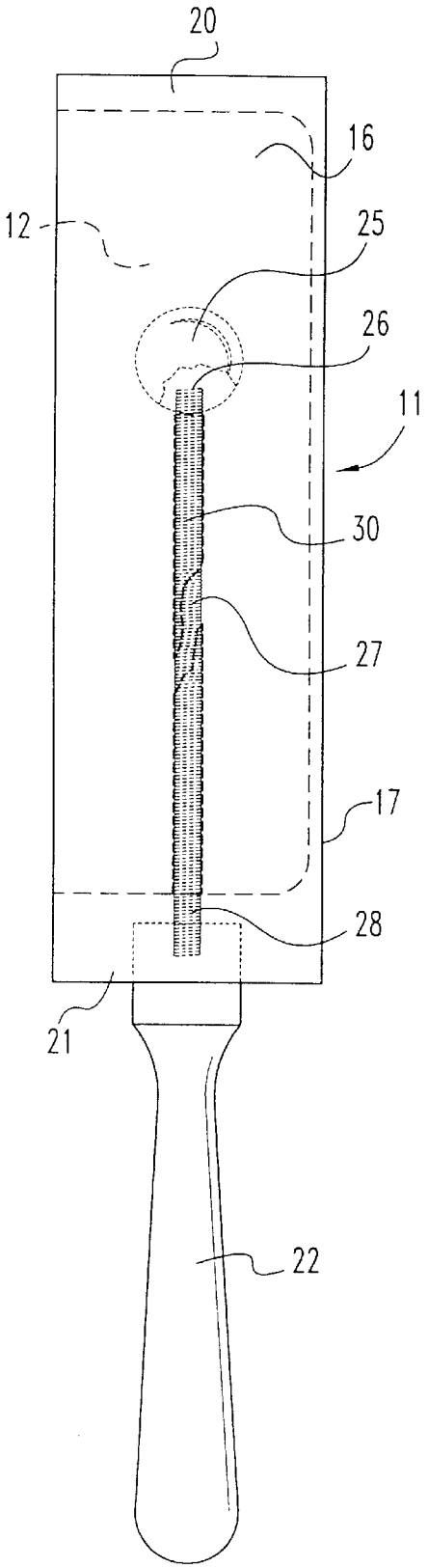
FIG. 3 is a side elevation taken from the right side of FIG. 2.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring more particularly to the drawings, the game call 10 includes an elongated open sided wooden box 11. In the illustrated embodiment, the wooden box 11 is formed of one piece of wood and has a rectangular recess 12 formed in that recess. The elongated box 11 includes opposite closed sides 15 and 16 and rear closed side 17 as well as top 20 and bottom 21. The handle 22 is fixedly mounted in the bottom 21 of the box within a suitable bore in the bottom.

The handle 22, the elongated box 11 and a knocker ball 25 are all made of wood. The knocker ball 25 has a bore therein which fixedly receives a first end 26 of a coil spring 27 the second end 28 of which is fixedly mounted to the handle 22 and the bottom 21 of the elongated box 11. In the building of the device it was noted that the spring 27 was not sufficiently stiff to provide proper operation of the device and consequently a shrink tube 30 was placed over the spring 27 and heat was applied to the shrink tube 30 causing it to tighten on the spring 27 and provide greater stiffness to the spring 27. Such shrink tube material is commercially available from the following company: J.C. Whitney, 2319 S. Throop Street, Chicago, Ill. 60680-4108.

Figure 4:
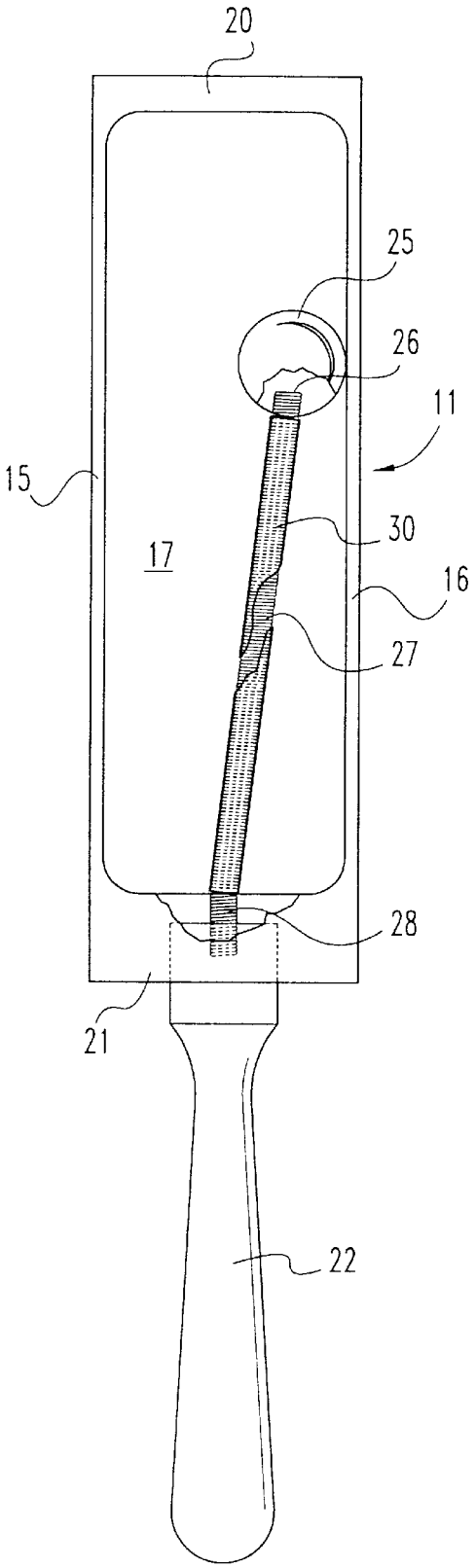
FIGS. 4 and 5 are views similar to FIG. 2 but showing serially positions of the knocker ball in performing the method of the present invention.
Figure 5:
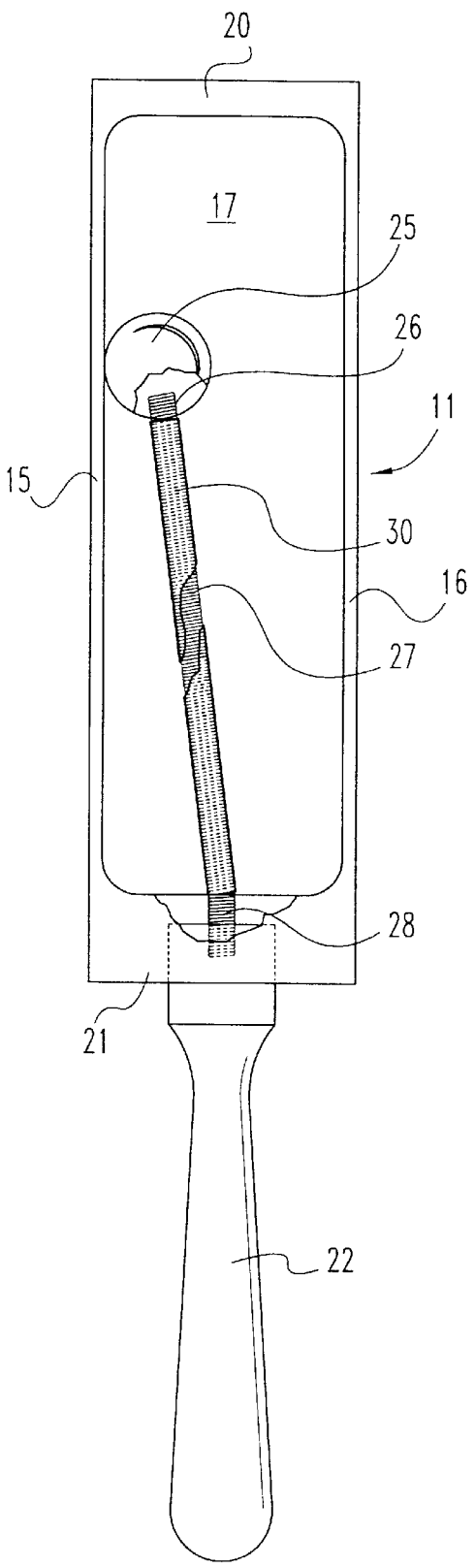

In order to locate and shock gobble a wild turkey, the user of the present device grasps the handle 22 and moves the handle back and forth so that the knocker is caused to strike against the opposite sides 15 and 16 repeatedly as shown in FIGS. 4 and 5. The moving of the handle is accomplished in short fast bursts so that the noise produced sounds like the pecking of a woodpecker. Preferably the striking of the knocker against the opposite sides occurs in a series of strikes of the knocker striking first one side and then the other side approximately ten to twenty times to define a burst. The striking occurs sufficiently quickly so that more than one strike occurs in a second. Preferably the method is practiced by making at least three bursts with a time interval between the bursts being at least a few seconds. Such a procedure is in accord with the natural practice of a woodpecker making the woodpecking sound of the woodpecker pecking on wood. The turkey responds to the woodpecking sound by making a gobble sound that is heard by the hunter who can then locate the turkey. Depending on how far away the turkey is, the hunter can then use commercially available game calls which make purrs, cuts and yelps to locate the turkey at closer range.

In one embodiment of the invention, the elongated box 11 had a length of 6½". The coil spring hand a length of 4½" and the knocker ball had a diameter of ¾". In one embodiment of the invention the wood used to make the game call was maple. It should be understood however that various kinds of wood such as maple, oak, cherry or any sort of wood could be used for the knocker ball, elongated box and the handle.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A game call comprising:

an open sided, wood, elongated box having three closed sides, a top and a bottom, said three sides including two opposite sides and a back side, a handle fixed to the bottom of said box, a wood knocker ball, a coil spring having first and second opposite ends with said first end fixed to said knocker ball and said second end fixed to said handle and to the bottom of the box and a shrink tube surrounding said coil spring and arranged to stiffen the coil spring and to position the knocker ball in spaced relation to the three closed sides of said box whereby said knocker ball is adapted to strike the opposite sides of the box when the box is moved rapidly back and forth by an individual grasping the handle to make a sound like a woodpecker.

2. A game call comprising:

an open sided elongated box having three closed sides, a top and a bottom, said three sides including two opposite sides and a back side, a knocker ball, a spring having first and second opposite ends with said first end fixed to said knocker ball and said second end fixed to the bottom of the box, whereby said knocker ball is adapted to strike the opposite sides of the box when the box is moved rapidly back and forth by an individual to make a sound like a woodpecker, said spring being a coil spring and additionally comprising a shrink tube surrounding said coil spring and to position the knocker ball in spaced relation to the three closed sides of the box.

3. The game call of claim 2 additionally comprising a handle fixed to the bottom of said box.

4. A game call comprising:

an open sided elongated box having three closed sides, a top and a bottom, said three sides including two opposite sides and a back side, a handle fixed to the bottom of said box, a knocker ball, a coil spring having first and second opposite ends with said first end fixed to said knocker ball and said second end fixed to said handle and to the bottom of the box and a shrink tube surrounding said coil spring and arranged to stiffen the coil spring and to position the knocker ball in spaced relation to the three closed sides of said box whereby said knocker ball is adapted to strike the opposite sides of the box when the box is moved rapidly back and forth by an individual grasping the handle to make a sound like a woodpecker.

* * * * *